United States Patent [19]

Tisma

[11] Patent Number: 5,058,634

[45] Date of Patent: Oct. 22, 1991

[54] AUTOMATIC PACKAGING MACHINE FOR PARTICULATE MATTER

[75] Inventor: Steven Tisma, Chicago, Ill.

[73] Assignee: Tisma Machine Corporation, Chicago, Ill.

[21] Appl. No.: 463,116

[22] Filed: Jan. 11, 1990

Related U.S. Application Data

[63] Continuation-in-part of Ser. No. 349,224, May 9, 1989, Pat. No. 5,010,929, which is a continuation-in-part of Ser. No. 164,010, Mar. 4, 1988, Pat. No. 4,856,566.

[51] Int. Cl.[5] ..... B65B 3/16

[52] U.S. Cl. ..... 141/129; 141/177; 141/179; 141/270; 141/310

[58] Field of Search ..... 141/129, 144, 147, 171, 141/177, 178, 179, 137, 135, 271, 270, 310, 145, 272, 99, 103, 165

[56] References Cited

U.S. PATENT DOCUMENTS

| | | | |
|---|---|---|---|
| 2,225,336 | 12/1940 | Foster et al. | 141/179 |
| 2,910,212 | 10/1959 | Kerr | 141/145 |
| 3,045,720 | 7/1962 | Jungmayr et al. | 141/135 |
| 3,100,584 | 8/1963 | Bauder | 141/147 |
| 3,152,622 | 10/1964 | Rothermel | 141/179 |
| 3,474,836 | 10/1969 | Schwake et al. | 141/272 |
| 4,821,861 | 4/1989 | Shanahan | 141/310 |
| 4,848,421 | 7/1989 | Froese et al. | 141/114 |

FOREIGN PATENT DOCUMENTS

| | | | |
|---|---|---|---|
| 557077 | 5/1958 | Canada | 141/147 |
| 2534554 | 2/1977 | Fed. Rep. of Germany | 141/103 |
| 449211 | 2/1913 | France | 141/310 |
| 690215 | 4/1953 | United Kingdom | 141/147 |

*Primary Examiner*—Ernest G. Cusick

*Attorney, Agent, or Firm*—Laff, Whitesel, Conte & Saret

[57] ABSTRACT

An automatic packaging machine can load light and fluffy particulate product without having it scattered over a large area. The system does this by using a plurality of inclined planes to cause said product to slide in successive small steps, as distinguished from simply dropping in a single fall. The system also tips a box and provides a vent to prevent air from being entrapped and compressed within a box as it is being filled.

20 Claims, 8 Drawing Sheets

30
32
72
84
100
104
116
126
F
110
114
134
138
K
111

AUTOMATIC PACKAGING MACHINE FOR PARTICULATE MATTER

This is a continuation-in-part of Ser. No. 07/349,224, filed May 9, 1989, now U.S. Pat. No. 5,010,929, which in turn was a continuation-in-part of Ser. No. 7/164,010, filed Mar. 4, 1988, now U.S. Pat. No. 4,856,566.

BACKGROUND OF THE INVENTION

This invention relates to automatic packaging machines, and more particularly to machines for packaging very light particulate matter.

Reference is made to U.S. Pat. No. 4,856,566 which shows some of the aspects that are shown in this disclosure. That patent cites, as prior art the following U.S. Pat. Nos. 1,666,931; 2,910,212; 4,514,954, and U.S.S.R. Patent 735,492.

There are many different kinds of products which might be packaged by the inventive machine. However, to provide a specific example, one might refer to certain infant cereals, such as pabulum, for example. This cereal is comprised of flakes which are, perhaps, between about $\frac{1}{8}$ and 3/16 of an inch in diameter and which are thinner than a sheet of typing paper. Particulates this light and fluffy almost float in the air, falling relatively slowly, when poured, so that they scatter if subjected to turbulent air. On the other hand, these same particulates tend to form a relatively dense and compact structure when they are resting in a pile or are sliding in bulk through a tube, because almost no air is trapped within the pile as it settles. A bulk lot of the particulates tends to plugs a tube while sliding through it, much as a piston closes a cylinder while sliding through it.

When this type of material is packaged, there is a unique and a substantial problem since the air movement caused by pouring the light particulate material causes it to fly away and scatter over a wide area. On the other hand, pouring this kind of a cereal into a box causes it to plug the box and act as a piston sliding down a cylinder formed by the box wall, which compresses air in the bottom of the box. As the density of the compressed air increases, there is a blow back which puffs the falling particulates out of the box. As a result, the usual packaging machine for such a material has a layer of particulates laying over everything within a close area.

This problem results in a potentially insanitary condition which requires a continuous clean up if the particulates are food particles, as with pabulum. It also results in a great variation in the weight of boxes. This is expensive since it becomes necessary to package enough particulates so that the lightest box still contains the posted weight, which means that the particulate material is being given away free in the heaviest boxes. Forms of particulate materials other than foods present different considerations, but the general principles are the same. It is difficult to pour many substances into a box without scattering that substance over almost everything in sight.

Accordingly, an object of the invention is to provide new and improved means for and methods of packaging particulate material. In this connection, an object is to prevent particulate material from scattering while it is being packaged. Here an object is to enable air to escape from a box while a light, fluffy particulate material is being poured into it during packaging.

Another object of the invention is to provide new and novel loading means for giving greater flexibility in the described form of packaging wherein packaging may be by either weight or volume, and may be varied quickly and easily by making only a few relatively simple adjustments.

Still another object of the invention is to provide packaging machines of the above described types which lend themselves to computerized controls so that they lend themselves to future improvement.

In keeping with an aspect of the invention, these and other objects are accomplished by providing an automatic packaging machine having volumetric cups which may be made larger or smaller responsive to either manual of electronic command signals. As boxes approach a fill station, they may tip to the side so that the particulate material, in effect, rolls down a side of the box, allowing air to escape without being entrapped in the bottom of the box.

BRIEF DESCRIPTION OF THE INVENTION

A preferred embodiment of the invention is shown in the attached drawings, wherein.

Figure 7:
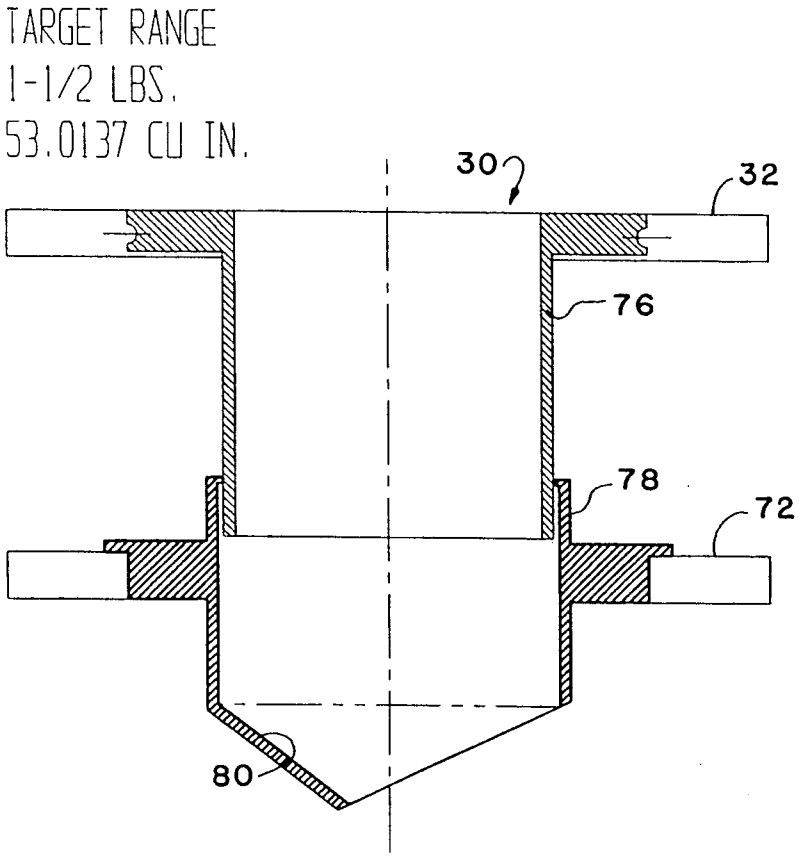
FIGS. 6, 7 show alternative forms of the volumetric fill cup of FIGS. 4, 5.
Figure 6:
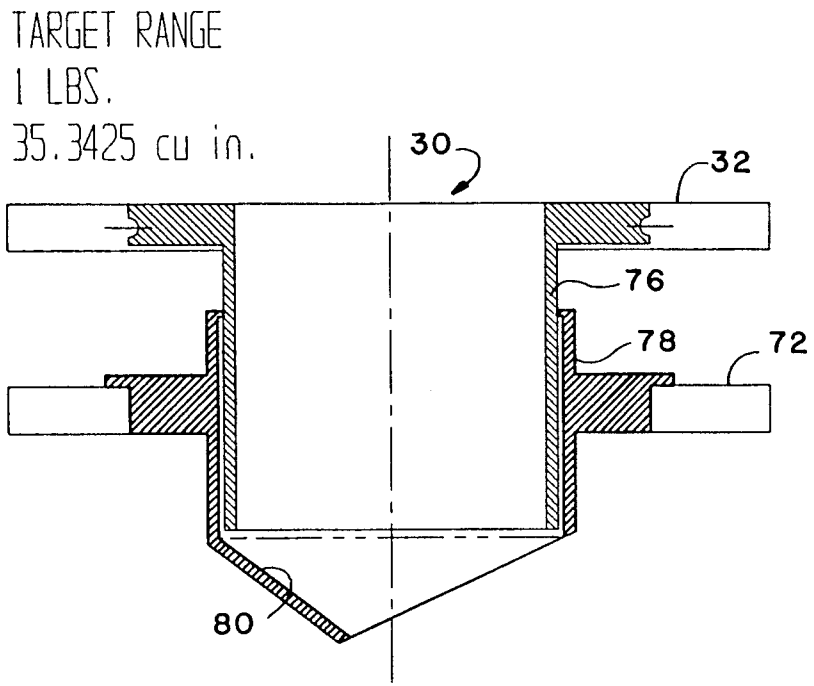
Figure 10:
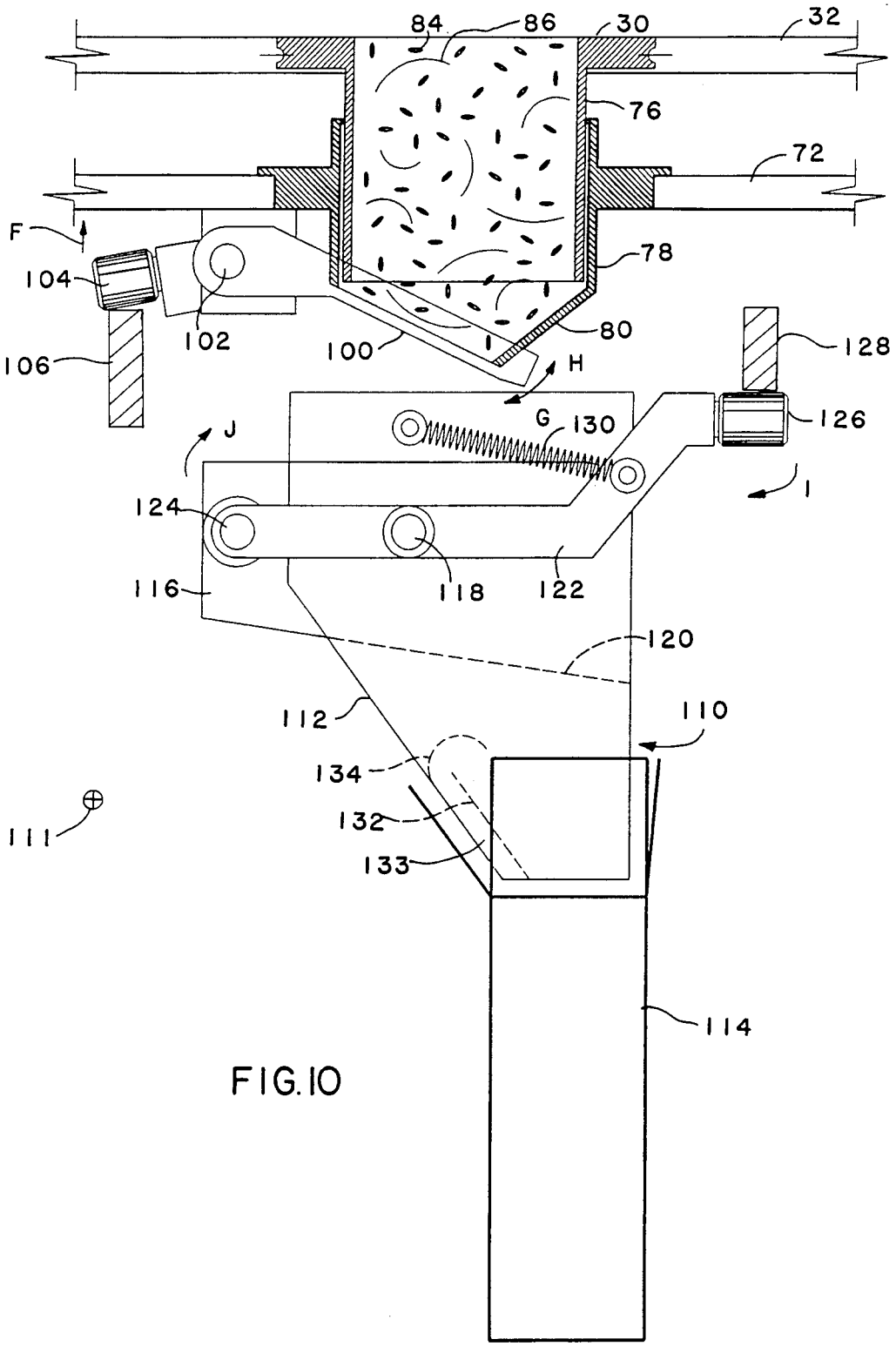

FIG. 10 schematically shows, in side elevation, a mandrel with an air venting baffle and a use of the fill cup of FIGS. 6, 7;

FIG. 11 has a sequence of five stop motion views A–E showing steps which the packaging machine may follow to fill a box by a use of a mandrel with an air venting baffle; and FIG. 12 has a sequence of seven stop motion views of steps A–G, showing how the packaging machine may fill a tipped box.

DETAILED DESCRIPTION OF THE INVENTION

Figure 2:
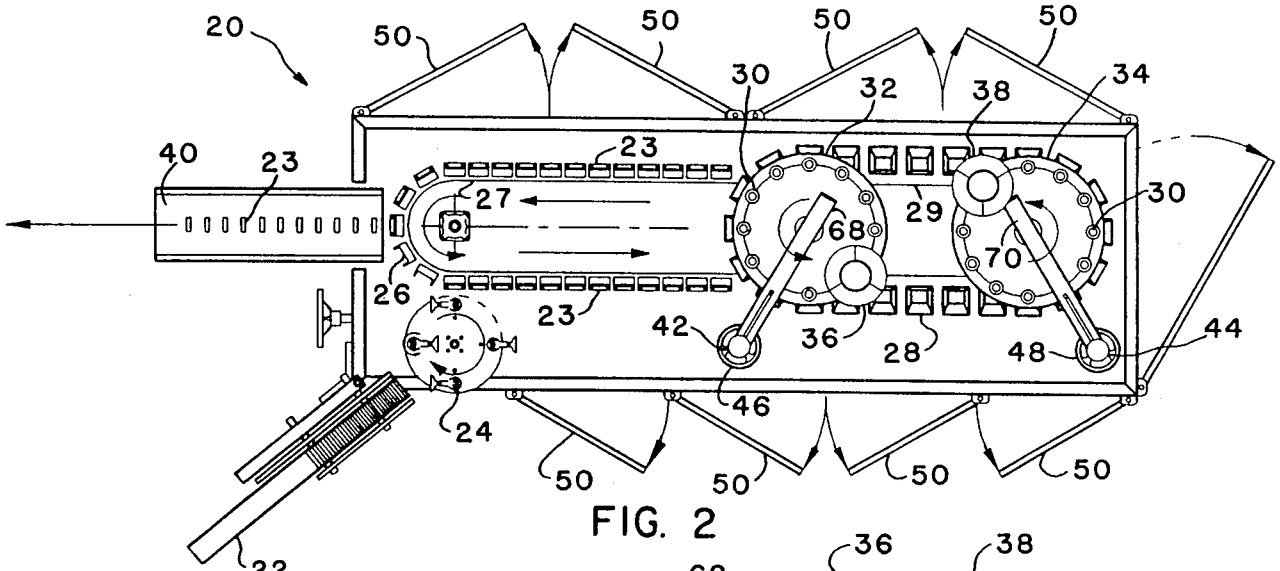
FIG. 2 shows a plan view looking down on the top of the machine of FIG. 1.
Figure 1:
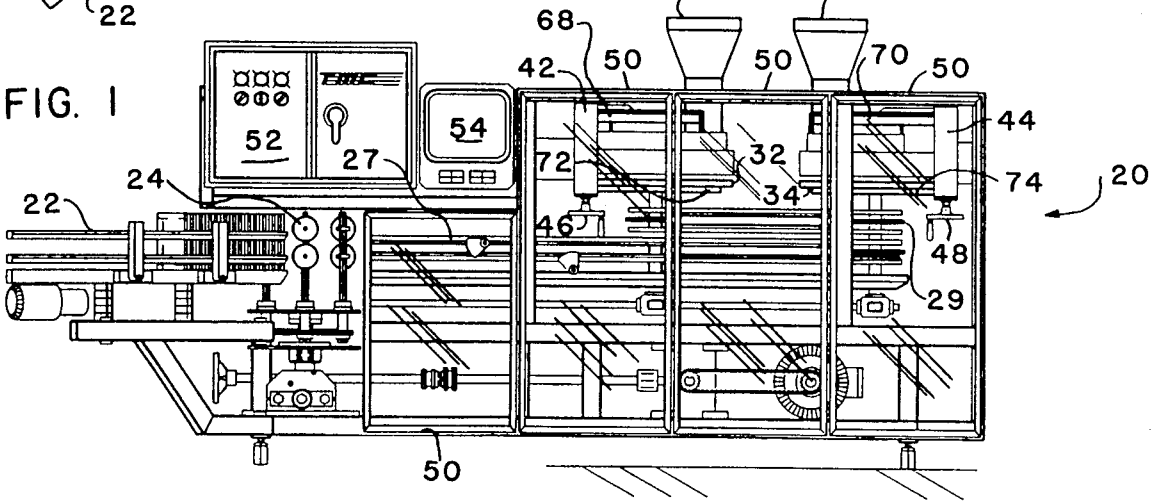
FIG. 1 shows a side elevation of the inventive packaging machine.

FIGS. 1, 2 show an exemplary packaging machine 20 having a magazine 22 for holding folded cardboard blanks that may be unfolded, opened and formed into any suitable packaging container, such as, cardboard boxes 23. A plurality of vacuum cup 24 pick up the blanks, one at a time, and insert them into individually associate mandrels 26 carried by a first endless chain conveyor 27. As the mandrels carrying the boxes travel, they pass under a number of guiding and directing means in the form of fill chutes 28 carried by another conveyor chain 29 positioned over the first conveyor. A fill chute is, in effect, a funnel for guiding and directing product into a box while it is being carried by a mandrel 26.

A plurality of volumetric fill cups 30 are mounted on two merry-go-rounds 32, 34 disposed above conveyor chain 28 and the mandrels 28 which it carries. Each of these cups picks up a measured amount of product and dumps it through a fill chute 28 and into an underlying box in a mandrel 26. This way each box receives exactly a prescribed amount of product, as measured by an individual fill cups 30. The fill cups are loaded from hoppers 36, 38. In an alternative arrangement, scales may be interposed between the hoppers 36, 38 and the fill chutes 28 so that product is dispensed by weight instead of by volume.

After the boxes 23 are filled, they are discharged via a conveyor 40. The conveyor 27 carries the resulting empty mandrels 26 back to receive another box 23 from a vacuum cup 24 that it picked up from magazine 22.

The merry-go-rounds 32, 34 are mounted on elevator mechanisms 42, 44, the elevation of which are controlled either by hand wheels 46, 68 or by stepping motors driven by computers. If the merry-go-rounds 32, 34 are raised or lowered slightly, the volume of the volumetric cups are made larger or smaller. If the merry-go-rounds are raised or lowered substantial distances, they may be swung out of the cabinet, thus exposing underlying machinery for easy maintenance, cleaning, replacement, or the like. When so swung out of the cabinet, the volumetric cups may be easily changed to alter the volume that is delivered.

Suitable controls are provided at 52. A computer read out display is provided at 54. A number of access doors 50 swing open or shut to enable workers to clean, maintain, or adjust the machinery.

In FIG. 1, 2, the two merry-go-rounds 32, 34 are fairly close together in order to both serve the same stream of boxes 23 which are being carried by mandrels 26. One merry-go-round 32 might load every other box, carried by a mandrel (say the odd numbered mandrels) while the other merry-go-round 34 fills boxes 23 carried by the interspersed mandrels (say the even numbered mandrels). In the alternative, one merry-go-round might place one kind of product in a box and the other merry-go-round might place another kind of product in the same box. For example, merry-go-round 32 might deposit sugar in a box while merry-go-round 34 might place coffee whitener in the same box.

Figure 3:
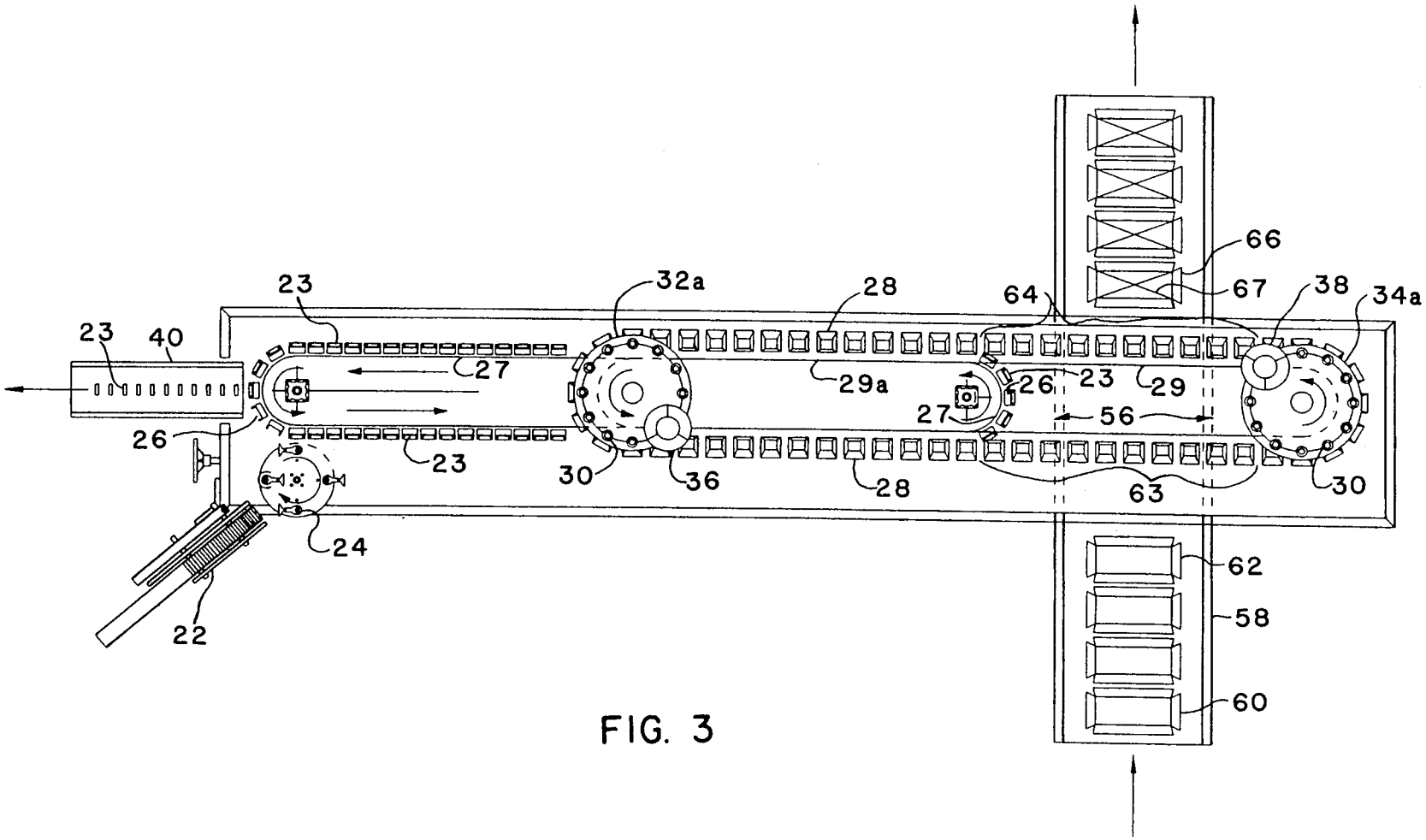
FIG. 3 shows a modification of the plan view of FIG. 2 which enables a bulk loading of relatively heavy boxes.

In FIG. 3, the conveyor chain **29*a* is made longer so that the merry-go-round 34*a* is positioned some distance away from the merry-go-round 32*a* to provide a free space forming an alley 56 between them. Otherwise, the system of FIG. 3 is the same as the system described above in connection with FIGS. 1, 2. The alley 56 provides room for a conveyor belt 58 to pass through the packaging machine and beneath the product dispensing fill chutes 28. The conveyor 58 is programmed to operate in a step-by-step manner presenting bulk sized boxes 60 one at a time to fill stations. Then, conveyor 58 waits for the box 60 to be filled. This way the machine may be programmed to dispense bulk amounts into large boxes 60. For example, the machine of FIGS. 1, 2 may have a plurality of relatively small volumetric cups 30 which may be adjustable up to some limit. Perhaps, the machine of FIGS. 1, 2, may fill boxes in any amount up to one-pound. However, the manufacturer may also wish to sell bulk amounts such as 10, 20, 30 pound boxes, which are packaged by the machine of FIG. 3**.

To provide such bulk amounts, the user programs the conveyor 58 to stop while the fill chutes 28 drop any number of units of product into one of the large boxes 60, being carried by the conveyor belt 58. Thus, for example, the large box 62 might be a 20-pound box which is waiting two steps away from a first fill position where the product carried by ten mandrels 63 loaded by merry-go-round **32*a* are dumped into a large box. In another two steps, the box 62 will reach a second fill position where the product carried by ten fill mandrels 64 loaded by merry-go-round 34*a* are dumped into a large box. Thus, for example, the box 62 may be filled with 20-pounds by the time that it reaches position 66. (An "X" mark 67 indicates that the box 66** is filled.)

In the foregoing example, it is assumed that the merry-go-round **32*a* dumps the first 10-one-pound lots and the merry-go-round 34*a* dumps the second 10-one-pound lots into box 62**. Of course, the machine may be programmed to operate in any other suitable manner and to dump any suitable amount of product into almost any size box.

Figure 5:
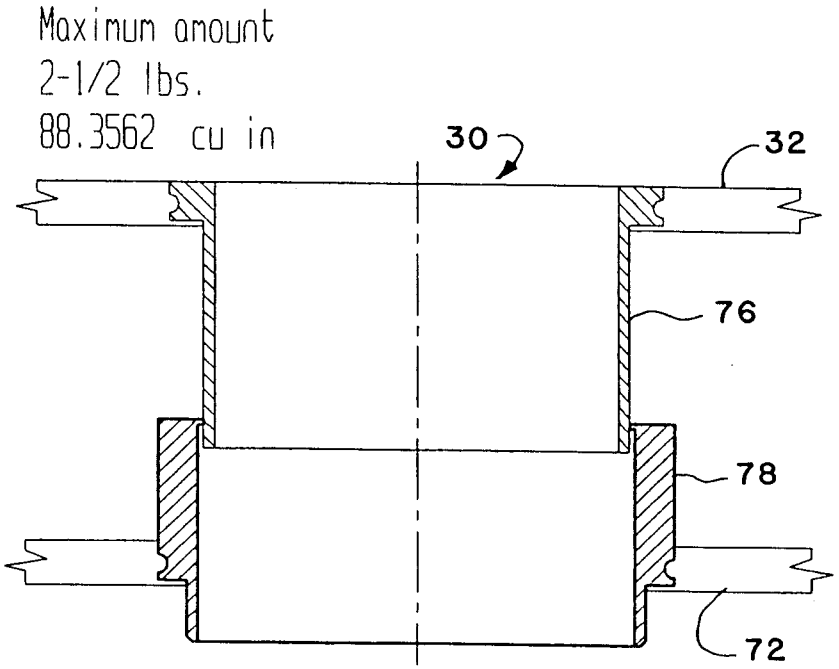
FIGS. 4, 5 show a volumetric fill cup which may be adjusted automatically in order to change a box size.
Figure 4:
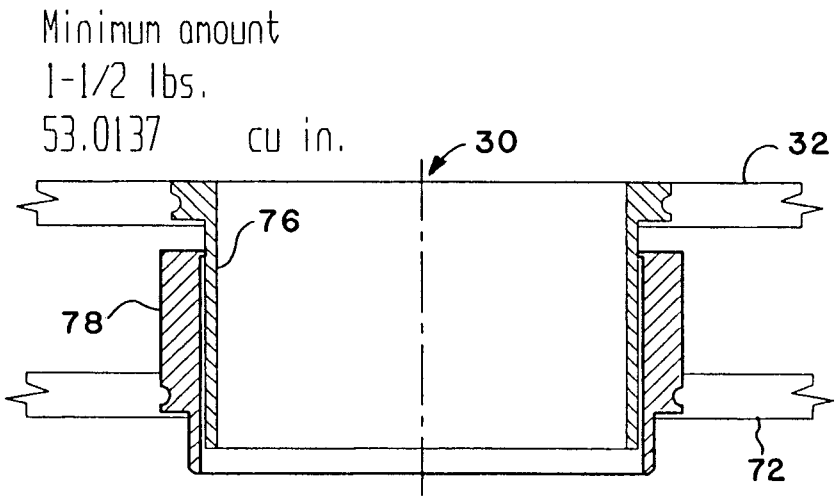

FIGS. 4, 5 show volumetric fill cups having a total volume which may be adjusted quickly and easily by raising or lowering elevators 42, 44 (FIGS. 1, 2). More particularly, FIGS. 2, 3 show volumetric fill cup 30 as being mounted in a circular pattern on the merry-go-rounds 32, 34. The merry-go-rounds are, in turn-held suspended under a swing arm 68, 70 which may be raised or lowered by an elevator mechanism 42, 44 which in turn is raised and lowered by a hand wheel 46, 48. Of course, an automatic computer controlled mechanism may replace the hand wheel.

The merry-go-round has two circular plates 32, 72, each carrying one of a pair of telescoping tubes 76, 78, also shown in the parent application cited above. In FIG. 4, the merry-go-round plates 32, 72 are relatively close together because the circular plate 32 has been lowered toward plate 72. This means that the telescoping tubes 76, 78 are slid together to encompass a relatively small volume such as 1½ pounds or 53.0137 cubic inches. FIG. 5 has been drawn to show that plate 32 has been raised, thereby extending the telescoping tubes 76, 78 to encompass a larger volume, such as 2½ pounds or 88,3562 cubic inches. It should be apparent that any other suitable volume may be selected by selecting the height to which the circular plate 32 is raised, and by changing cups 30 to provide telescopic tubes having larger or smaller inside diameters. Either handwheels or stepping motors may be provided to raise or lower plate 32. When the stepping motors are used, a prescribed member of stepping pulses are fed to them to give the volumetric cups a precise volume.

There is a limit as to how large the diameter and how long the telescoping tubes may be made for any given merry-go-round and elevator mechanism. Therefore, for any given packaging machine, at some size, the volumetric cups have reached their maximum size, beyond which, they cannot be made larger. When this limit is reached, two or more fill cups may cooperate to increase the amount of product that can be loaded into a box. For example, if FIG. 5 shows a maximum volume for a given cup 30 and if the manufacturer wishes to fill a larger box (100-cubic, inches, for example), two volumetric cups are used. Thus, for example, the cups 30 on merry-go-round 32 may be set at 75-cubic inches while the cups on merry-go-round 34 are set at 25-cubic inches. Each individual box receives one charge of product from each merry-go-round so that it receives a full charge of 100-cubic-inches after each merry-go-round has dumped product into it.

FIGS. 6, 7 show a similar set of telescoping tubes to provide a similar arrangement, but with a sloping bottom 80 for cooperating with a gate in order to divert product to one side. Except for the structure 80 and gate at the bottom of the cup, FIGS. 4, 5 and 6, 7 are the same. The emptying of the FIGS. 6, 7 cup 30 is controlled by a gate on the cup. The emptying of the FIGS. 4, 5 cup is controlled by openings in an underlying plate which is part of the cause of the particulate problem solved by this invention.

Figure 9:
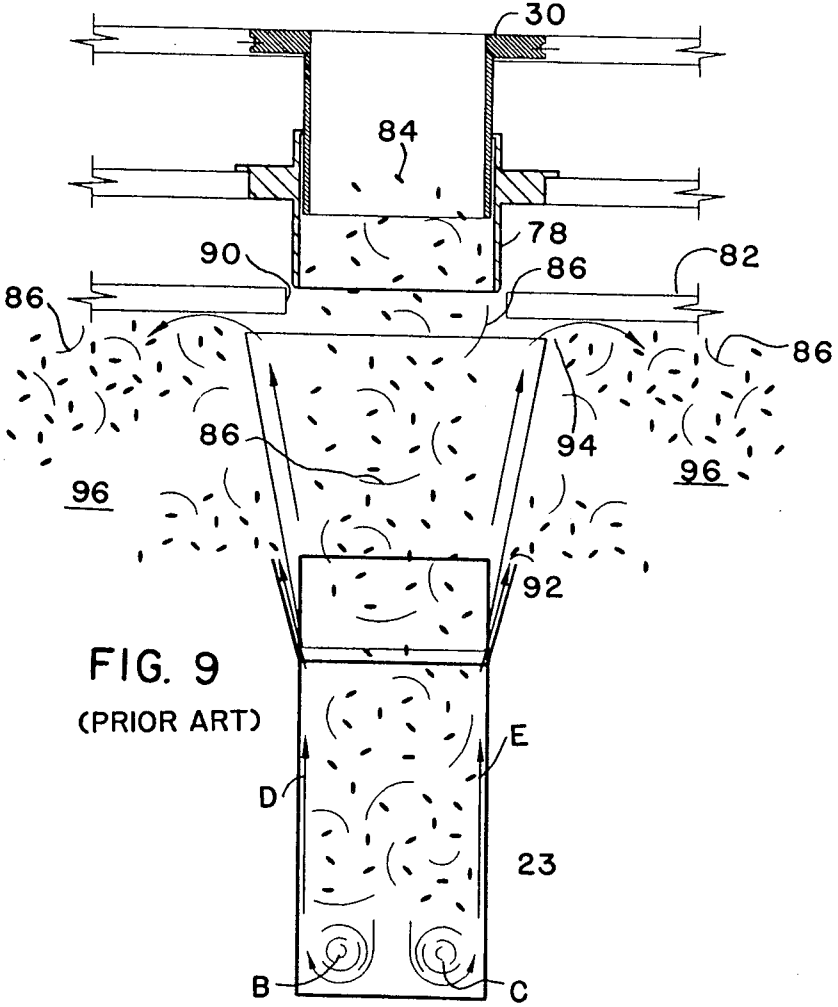
FIG. 9 (PRIOR ART)
FIG. 9 shows a box being filled by the fill cup of FIGS. 6, 7 and illustrates the problem which the invention overcomes.
Figure 8:
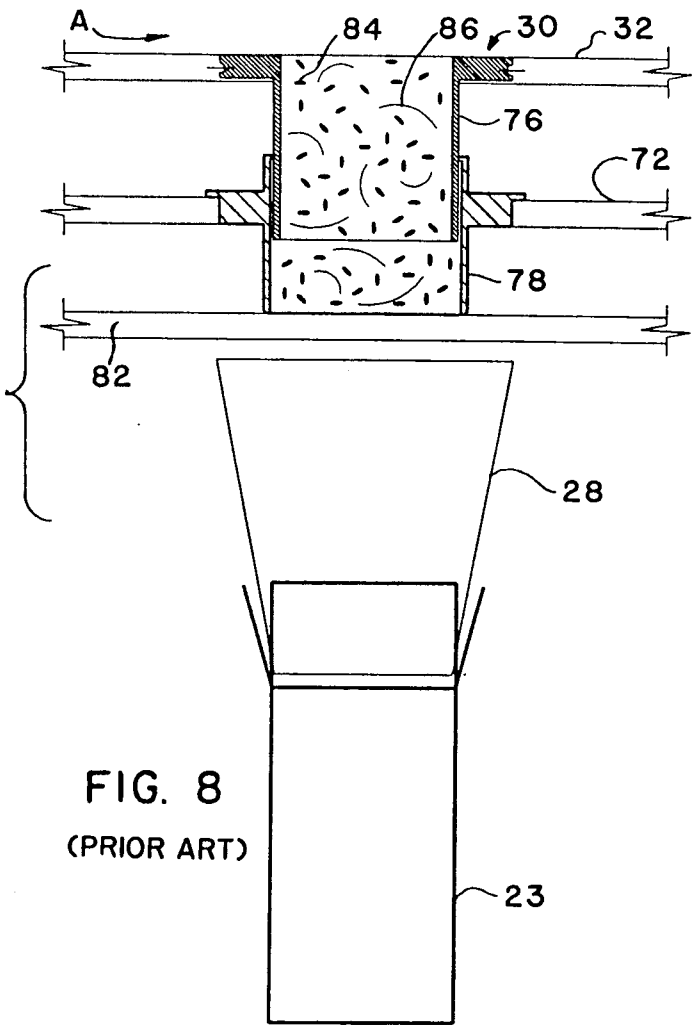
FIG. 8 (PRIOR ART)
FIG. 8 shows a use of the fill cup of FIGS. 6, 7 preparatory to filling a box with a light and fluffy particulate material.

FIGS. 8, 9 illustrate the particulate problem which is solved by the invention. In FIG. 8, there is an underlying plate 82 over which the tube 78 slides. The solid plate provides a bottom for the cup 30 of FIGS. 4, 5. The cup 30 is being carried in direction A, by the merry-go-round 32. Plate 82 stands still. The cup 30 (FIG. 8) is filled with a very light and fluffy particulate material 84 which is especially difficult to load. A number of arcuate lines 86 are included within the particulates in order to show that the particulate product material is so light and fluffy that it is in agitation and in an unstable condition, as the cup 30 slides over the surface 82. Traveling under and in alignment with cup 30 is a filling chute 28. A mandrel 26 (FIG. 2, 3) is carrying a box 23 which is traveling under the fill chute.

In FIG. 9, the cup 30 reaches a point in its travel where tube 78 passes over an opening 90 in the stationary plate 82. At this point, the particulate product 84 falls through opening 90. Again, because it is light and fluffy, the particulates tend to almost float in the air, as shown by the many arcuate lines 86.

Still the falling pile of particulate product tends to fill the box 23, sliding through and filling it somewhat as a piston tends to slide through and fill a cylinder. This piston like action of the falling particulate product tends to compress air in the bottom of the box, as is shown by the swirling air at B, C. As the air in the bottom of the box becomes compressed, it exerts an upward force, resisting further compression.

When the upward force exceeds the weight of the falling particulate product, the compressed air B, C, blows the particulates upwardly, as is indicated by the arrows D, E. As a result, the particulate material escapes confinement at any opening through which it may pass, as at 92 for example. Even if it were somehow possible to seal all of these passage ways, it would not solve the problem, because the particulate matter would then blow back through the fill cups 30. Thus, a cloud 96 of the particulate product settles around the area under opening 90 and in any other place where drafts of air may carry it.

If the particulate product 84 is a food product, it must be cleaned-up immediately to prevent the formation of a breeding ground for bacteria. This means that, if the product is pabidum, for example, the packaging machine must be shut down for cleaning at frequent intervals. If a vacuum system is installed to carry away the escaping cloud of material 96, the negative pressure draws out greater amounts of the particulate, thus increasing the loss and the cost of the product.

The inventive fill system (FIG. 10), preferably includes the volumetric fill cup of FIGS. 6, 7 with the slanting bottom guide 80 which is normally closed by gate 100, pivoted at 102, and controlled by a roller 104 which rolls over the upper surface of a side fence 106. When the profile of fence 106 allows the roller 104 to drop to the level shown in FIG. 10, gravity causes gate 100 to keep the bottom of the chute 78 in a closed position. When the top of fence raises, the roller 104 moves upwardly (direction F), thus causing the gate 100 to pivot around point 102, moving gate 100 down in direction G. When the profile of side fence 106 lowers the roller 104 to the position seen in FIG. 10, the gate pivots about point 102 to swing in direction H to a closed position.

The speed at which gate 100 opens or closes may be controlled by the profile at the top of side fence 106. If the profile raises with a low sloping angle, the gate opens slowly. If there is an abrupt raise in the profile, the gate opens suddenly. The preferred opening is slowly enough so that the particulate product tends to roll off the gate 100, as distinguished from falling through an opening.

The fill chute 110 travels under the volumetric cups 30. At 111, we see the tall feathers of an arrow indicating that the direction of travel is perpendicular and into the plane of the sheet of paper carrying FIG. 10. One part of fill chute 110 is somewhat funnel shaped, having an inclined surface 112 leading to the open top of a box 114 for receiving the product. A second part of the fill chute 110 is a tray 116 which is pivotally mounted at 118 inside of a hopper-like top of chute 110. Tray 116 has a sloping bottom panel 120 which causes the particulate product to slide toward the right-hand (as viewed in FIG. 10) wall of the chute.

The position or attitude of tray 116 is controlled by an actuator arm that it attached to tray 116 at a pivot point 124 and to the chute 110 at the pivot point 118. A roller 126 on the end of actuator arm 122 rides on the bottom of a fence 128. Spring 130 holds the roller 126 against the bottom of fence 128. As the profile of fence 128 goes down, it pushes roller 126 down (direction I). The back of the tray 116 moves up (direction J) to dump the contents of the tray 116 into chute 110. When the profile of fence 128 returns to the elevation seen in FIG. 10, spring 130 pulls the arm 122 back to the position seen in the drawing, thus returning the tray to its normal position.

It should now be clear that the profiles of side fences 106, 128 cause the gate 100 and tray 116 to cooperate with each other to transfer the product from the cup 30 into the box 114. The gradualness of the gate and tray movements is such that, ideally, the particulate product 84 rolls down two inclined planes, as distinguished from sliding or simply dropping. Rolling produces less turbulence within the product and, therefore, less tendency to scatter.

Inside the chute 110 is a vent plate 132 which provides an escape route 133 for air, hopefully before it is entrapped within the box 114 by the falling product. The vent plate 132 is under the falling product, thus the escape of air is not blocked by a bulk mass of product in the tray. A cover 134 at the top of the vent formed by plate 132 prevents the particulate product from entering the vent.

Figures 11A, 11B, 11C, 11D, 11E:
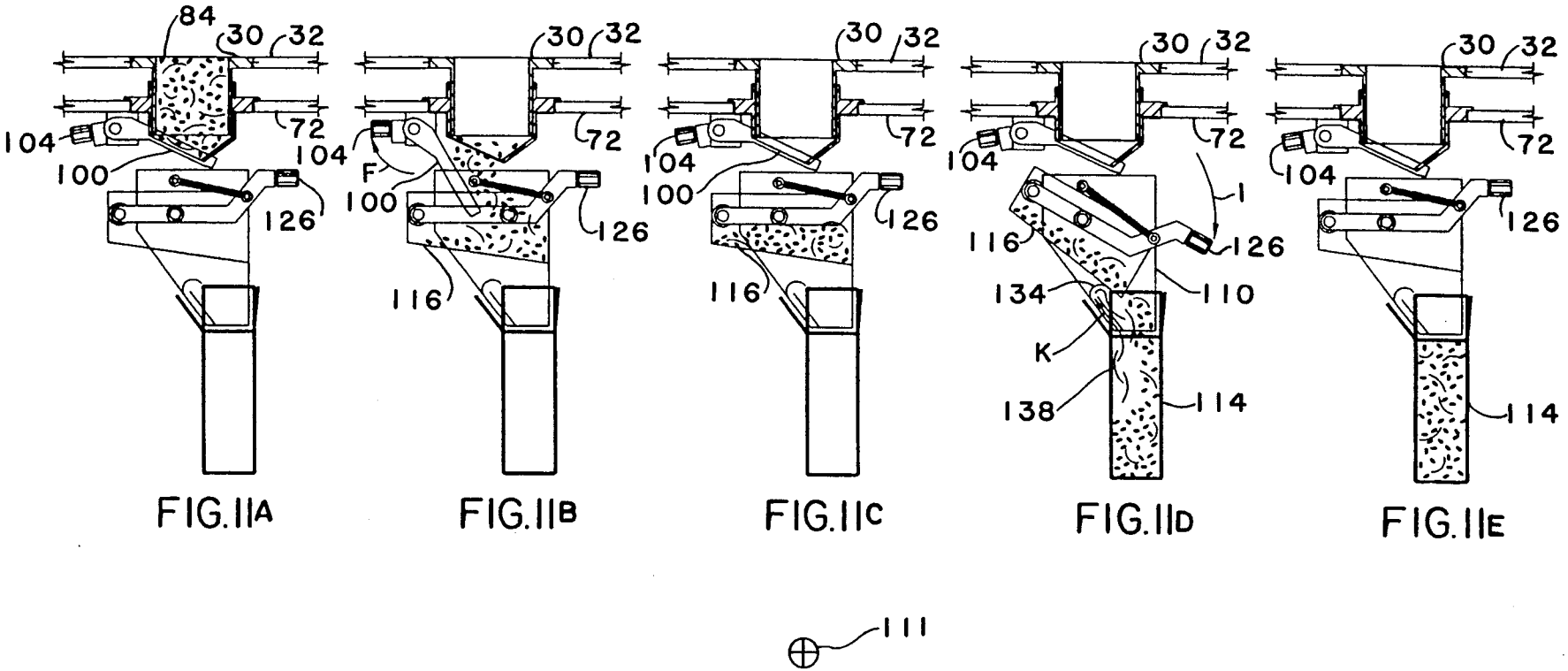

FIG. 11 shows five stop motion views which illustrate the fill cycle using the inventive structure of FIG. 10. In FIG. 11A, the volumetric cup 30 is filled with a particulate product, which is retained by a closed gate at the bottom of the cup.

In FIG. 11B, the roller 104 is moved in direction F, to open the gate 100, thereby causing the particulate product to fall into the tray 116, preferably with a rolling motion so that there is minimum amount of turbulence.

In FIG. 11C, the gate 100 has closed the bottom of the cup 30. The particulate product is being carried by the tray 116, thus giving it time enough to settle. Hopefully, the transfer from cup to tray has occurred with almost turbulence. Therefore, almost none of the product is displaced by air currents.

In FIG. 11D, the tray 116 is tripped and the product is falling into the box 114. Because the tray 116 is tipped toward one side of the box 114, the product tends to slide off the tray and to fall into the box without forming a plug; therefore, hopefully there is no piston like action as there is when the particulate product fills a cross-section of the box. Hence, little or no air is entrapped and compressed in the bottom of box 114. Instead, the air 138 within the box tends to escape up the side of box 114, which is opposite the filling side, as indicated by arrow K. This air escapes under the cover 134 of the air vent formed by plate 132 (FIG. 10). It should be noted that the product pouring off the edge of tray 116 is beyond the cover 134.

In FIG. 11E, the particulate product is inside box 114. An arrow in FIG. 11E shows the air escaping from the box, through the vent, and on to the ambient atmosphere. The only remaining step is to close and seal the cover flaps at the top of the box.

Upon review of FIG. 11, it will be observed that the step of FIG. 11D still has a vertical drop. In view of the relatively turbulent free, two step drop from cup 30 to tray 116 and from tray 116 to box 114, there is no problem with most products. However, some products are so light and fluffy that even this two step drop does not prevent some scattering disbursement of the product.

Figures 12A, 12B, 12C, 12D, 12E, 12F, 12G:
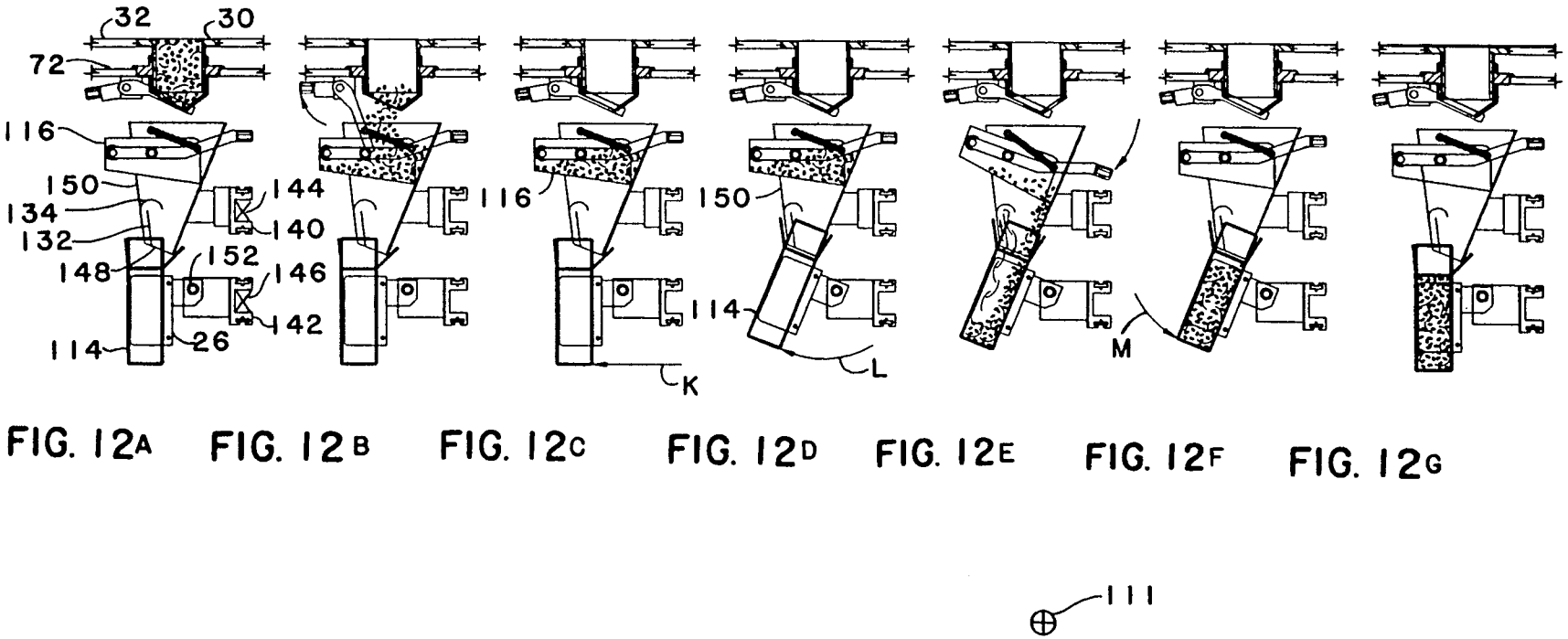

FIG. 12 shows a seven step fill cycle during which the box tips, in order to further reduce turbulence. In addition to the components shown in FIG. 10, FIG. 12A shows the brackets 140, 142 which are bolted to two link chain conveyors 144, 146, represented by "X" marks. Also, the bottom edge 148 of fill chute 150 is slanted to accommodate a tipped box. The fill chute 150 contains the vent plate 132 and cover 134.

The box carrying mandrel 26 is pivotally connected at 152 to the bracket 142 so that it (mandrel 26) can swing back and forth, as shown in the seven steps of FIG. 12. The attitude of the box may be controlled by a profile on a side fence, much as explained above in connection with rollers 104, 126 (FIG. 10) and fences 106, 128. This profile causes the box 114 to start to swing (arrow K, FIG. 12C) after the product is dumped from cup 30 and when it reaches tray 116. Before the product is dumped from tray 116 and into the box 114, the profile positions the box on an incline (as indicated arrow L, FIG. 12D). When it is so inclined, the side of the box is an incline extension of the inclined side of the file chute 150 (FIG. 12E) so that the product does not encounter any appreciable discontinuity. After the box fills, the profile returns it to an upright position (arrow M, FIG. 12F).

Finally, it will be observed that the slant of fill chute 150 is on the side opposite the slant in FIG. 10. This is so that the side of the fill chute adjacent the spilling end of tray 116 is aligned with the side of box. Therefore, we see that the right-hand (as viewed in FIG. 11D) edge of fill chute 110 is aligned with the right-hand edge of box 114 in the filling position so that the falling product does not encounter a physical discontinuity. Likewise, the right-hand edge of fill chute 150 (FIGS. 12E, F) is aligned with the box in the filling position, again so that the product does not encounter a physical discontinuity. With these inclined surfaces, the product tends to roll down an inclined plane, rather than to fall in a straight drop.

It should also be apparent that the side fence profile which controls the attitude of box 114 may become quite sophisticated so that the box may initially tip at a large angle so that the initial drop begins slowly. The tipped angle of the box 114 may progressively decrease as the box fills until it comes to rest in a vertical position as the last of the product moves into the box.

Those who are skilled in the art will readily perceive how to modify the invention. Therefore, the appended claims are to be construed to cover all equivalent structures which fall within the true scope and spirit of the invention.

I claim:

1. An automatic packaging system for loading a particulate product into a box, said system comprising at least three conveyor means stacked vertically with respect to each other, an uppermost one of said three conveyor means carrying a plurality of fill cups for measuring predetermined portions of particulate product, each of said fill cups having a slanting bottom extending over a portion thereof, each of said fill cups having a bottom gate which moves from a closed position against said slanting bottom to an inclined position so that said product slides off said slanting bottom and onto said gate and thereafter slides off said inclined position of said gate, a central one of said three conveyor means carrying means for guiding and directing said portions sliding off said gate during a transfer of said portions from said fill cups to packaging containers, a lower one of said three conveyor means carrying said packaging containers to positions where they receive said transferred portions via said guiding and directing means, and means for transferring said product in at least two distinct steps from said fill cups to said guiding and directing means and then on to said packaging containers, each of said transfer steps being carried out via an inclined plane.

2. The system of claim 1 wherein said upper most one of three conveyor means includes means for loading a plurality of said fill cups into a single packaging container whereby the bulk of said product may be greater than said measured portion.

3. An automatic packaging system for loading a particulate product into a box, said system comprising at least three conveyor means stacked vertically with respect to each other, an uppermost one of said three conveyor means carrying a plurality of fill cups for measuring predetermined portions of particulate product, each of said fill cups having a bottom in the form of a gate which moves from a closed position to an inclined plane position so that said product slides off said gate, a central one of said three conveyor means carrying means for guiding and directing said portions during a transfer of said portions from said fill cups to packaging containers, said guiding and directing means including a tray which receives said product as it slides off said gate, means for thereafter moving said tray to another inclined plane position so that said product slides off said tray and into said packaging container, and a lower one of said three conveyor means carrying said packaging containers to positions where they receive said transferred portions via said guiding and directing means, and means for transferring said product in at least two distinct steps from said fill cups to said guiding and directing means and then on to said packaging containers, each of said transfer step being carried out via an inclined plane.

4. The system of claim 3 wherein said tray forms said another inclined plane at an angle which tends to cause said product to roll as it slides off said another plane.

5. The system of claim 3 and vent means associated with said guiding and directing means for enabling air to escape from said packaging container as it fills with said product.

6. The system of claim 3 and a vent plate associated with the means for guiding and directing, said vent plate forming a passageway for an escape of air from said box, under said falling product and into the ambient atmosphere.

7. The system of claim 6 and means for tipping said packaging container to enable a side of said container to form an inclined plane for said product to slide down as it fills said container.

8. The system of claim 7 wherein said packaging container is tipped at an angle which tends to cause said product to roll as it slides.

9. An automatic packaging system for loading a particulate product into a box, said system comprising at least three conveyor means stacked vertically with respect to each other, an uppermost one of said three conveyor means carrying a plurality of fill cups for measuring predetermined portions of particulate product, said upper most one of three conveyor means including means for loading a plurality of said fill cups into a single packaging container whereby the bulk of said product may be greater than said measured portion, a central one of said three conveyor means carrying means for guiding and directing said portions during a transfer of said portions from said fill cups to packaging containers, a lower one of said three conveyor means carrying said packaging containers to positions where they receive said transferred portions via said guiding and directing means, means for transferring said product in at least two distinct steps from said fill cups to said guiding and directing means and then on to said packaging containers, each of said transfer step being carried out via an inclined plane, said fill cups being carried by two merry-go-rounds which are displaced from each other to form an alley through said system, bulk conveyor means extending through said alley for moving bulk sizes of said packaging containers into fill positions, and means at two successive positions for transferring product from a plurality of said fill cups and into one of said bulk sized packaging containers at each of said two successive positions, and for operating said bulk conveyor for moving said bulk sized packaging containers through said successive positions so that a bulk sized packaging container is always being loaded at each of said fill positions.

10. An automatic packaging system for loading a particulate product into a box, said system comprising at least three conveyor means stacked vertically with respect to each other, an uppermost one of said three conveyor means carrying a plurality of fill cups for measuring predetermined portions of particulate product, said upper most one of three conveyor means including means for loading a plurality of said fill cups into a single packaging container whereby the bulk of said product may be greater than said measured portion, a central one of said three conveyor means carrying means for guiding and directing said portions during a transfer of said portions from said fill cups to packaging containers, a lower one of said three conveyor means carrying said packaging containers to positions where they receive said transferred portions via said guiding and directing means, means for transferring said product in at least two distinct steps from said fill cups to said guiding and directing means and then on to said packaging containers, each of said transfer step being carried out via an inclined plane, said fill cups being carried by two merry-go-rounds which are displaced from each other to form an alley through said system, bulk conveyor means extending through said alley for moving bulk sizes of said packaging containers into at least one fill position, and means for transferring product from a plurality of said fill cups and into one of said bulk sized packaging containers, and thereafter operating said bulk conveyor for moving said one bulk sized packaging container away from and another of said bulk sized packaging containers into said at least one fill position.

11. An automatic packaging system for loading a particulate product into a box, said system comprising at least three conveyor means stacked vertically with respect to each other, an uppermost one of said three conveyor means carrying a plurality of fill cups for measuring predetermined portions of particulate product, a central one of said three conveyor means carrying means for guiding and directing said portions during a transfer of said portions from said fill cups to packaging containers, a lower one of said three conveyor means carrying said packaging containers to positions where they receive said transferred portions via said guiding and directing means, means for transferring said product in at least two distinct steps from said fill cups to said guiding and directing means and then on to said packaging containers, each of said transfer step being carried out via an inclined plane, said fill cups being carried by two merry-go-rounds which are displaced from each other to form an alley through said system, bulk conveyor means extending through said alley for moving bulk sizes of said packaging containers into at least one fill position, and means for transferring product from a plurality of said fill cups and into one of said bulk sized packaging containers, and thereafter operating said bulk conveyor for moving said one bulk sized packaging container away from and another of said bulk sized packaging containers into said at least one fill position.

12. A packaging system comprising a fill cup for measuring a portion of product to be loaded in an automatic packaging machine, said fill cup comprising a pair of telescoping tubes supported by upper and lower plates to extend or retract said tubes responsive to a raising or lowering of said upper plate, gate means, said fill cup having a slant bottom extending over a portion thereof, a bottom gate which moves between a closed position against said slanting bottom and an inclined position where product sliding off said slanting bottom and onto said gate means further slides off said gate, and means for opening said gate by a restricted amount in order to form an inclined plane off of which product may slide in order to empty said fill cup, whereby said product slides off said inclined plane and is not simply dropped freely under gravity as it moves from said fill cup through said gate to an underlying location.

13. A packaging system comprising a fill cup for measuring a portion of product to be loaded in an automatic packaging machine, said fill cup comprising a pair of telescoping tubes supported by upper and lower plates to extend or retract said tubes responsive to a raising or lowering of said upper plate, gate means, said fill cup having an open bottom which is closed by said gate means, the bottom of the lower most telescoping tube having an inclined surface for guiding product onto said gate means, means for opening said gate by a restricted amount in order to form an inclined plane off of which product may slide in order to empty said fill cup, means for moving said fill cup, an underlying tray mounted to move with and to be filled by product sliding off said inclined plane as said fill cup empties, and means for tipping said tray at an angle which enables said product received from said fill cup to slide off said tray, whereby product may be transferred from said fill cups through said tray to another location, in a two step operation.

14. The system of claim 13 wherein there are a plurality of said trays, and means for transferring product from a plurality of said trays into underlying containers, thereby forming a bulk loading.

15. The system of claim 14 and means for moving said underlying containers in a step-by-step manner in order to receive said bulk loading.

16. The system of claim 14 and means for tipping said underlying container to receive said transferred product without entrapping air in said container when said product is transferred.

17. An automatic packaging system for loading a light and fully particular product, said system comprising means for transferring discrete portions of said product into boxes, and means for precluding an entrapment of air in said boxes by a plug of said product forming across the cross-section of one of said boxes when said product is transferred thereto, wherein said means for precluding entrapped air is a vent extending beneath a point where a plug of said product might form while it is being transferred into said boxes.

18. The automatic packaging system of claim 17 and means for holding said boxes in an attitude during the transfer of said discrete portions of said product, said attitude causing said product to slide down the side of said box as it is filled, and means for varying the attitude of said box as it is being filled to enable said particulate product to slide along the side of said box.

19. The automatic packaging system of claim 18 and a fence extending along a path followed by said boxes during said transfer of said product, said fence having a profile which controls the attitude of said box whereby different attitudes may be achieved by changing said profile of said fence.

20. An automatic packaging system for lading a light and fully particular product, said system comprising means for transferring discrete portions of said product into boxes, and means for precluding an entrapment of air in said boxes by a plug of said product forming across the cross-section of one of said boxes when said product is transferred thereto, wherein said means for preventing entrapped air comprises means for tipping said boxes to an angle which prevents said plug from forming when said product enters said boxes as they are filled.

* * * * *